US009478123B2

(12) United States Patent
Lee

(10) Patent No.: US 9,478,123 B2
(45) Date of Patent: Oct. 25, 2016

(54) REMOTE CONTROL DEVICE AND METHOD

(71) Applicant: INTELLECTUAL DISCOVERY CO., LTD., Seoul (KR)

(72) Inventor: Kwang Bum Lee, Seoul (KR)

(73) Assignee: INTELLECTUAL DISCOVERY CO., LTD., Seoul (KR)

( * ) Notice: Subject to any disclaimer, the term of this patent is extended or adjusted under 35 U.S.C. 154(b) by 0 days.

(21) Appl. No.: 14/413,795

(22) PCT Filed: Jul. 31, 2013

(86) PCT No.: PCT/KR2013/006824
§ 371 (c)(1),
(2) Date: Jan. 9, 2015

(87) PCT Pub. No.: WO2014/021605
PCT Pub. Date: Feb. 6, 2014

(65) Prior Publication Data

US 2015/0194050 A1 Jul. 9, 2015

(30) Foreign Application Priority Data

Jul. 31, 2012 (KR) ..... 10-2012-0083900
Jul. 31, 2012 (KR) ..... 10-2012-0083901

(51) Int. Cl.
*G08C 19/16* (2006.01)
*G08C 17/02* (2006.01)

(52) U.S. Cl.
CPC ..... *G08C 17/02* (2013.01); *G08C 2201/50* (2013.01); *G08C 2201/93* (2013.01)

(58) Field of Classification Search
CPC .. G08C 17/02; G08C 23/04; G08C 2201/92; G08C 2201/20; G08C 2201/93; G08C 2201/30; G08C 2201/50; H04N 5/4403; H04N 21/42204
USPC ..... 340/12.22
See application file for complete search history.

(56) References Cited

U.S. PATENT DOCUMENTS 7,126,468 B2 * 10/2006 Arling ..... G08C 17/00 340/3.3
2002/0071577 A1 6/2002 Lemay et al.
(Continued)

FOREIGN PATENT DOCUMENTS

KR 10-2002-0011028 A 2/2002
KR 10-2007-0020488 A 2/2007
(Continued)

OTHER PUBLICATIONS

International Search Report for PCT/KR2013/006824 dated Oct. 28, 2013.

*Primary Examiner* — Don N Vo

(57) ABSTRACT

The present invention relates to a method of controlling a device remotely and includes: transmitting a device selecting signal; receiving a response signal from a device to be controlled that receives the device selecting signal; identifying the device to be controlled by using the response signal; changing at least one of an angle of beam spread and direction of the device selecting signal if the identified device to be controlled is two or more in number; and generating a remote control signal by using device control information corresponding to the identified device to be controlled and transmitting the generated signal to the device to be controlled.

2 Claims, 16 Drawing Sheets

(56) References Cited

U.S. PATENT DOCUMENTS

| | | | | |
|---|---|---|---|---|
| 2006/0270458 | A1* | 11/2006 | Watanabe | G08C 17/02 455/562.1 |
| 2007/0210932 | A1* | 9/2007 | Koshiba | G08C 23/04 340/12.22 |
| 2007/0252721 | A1 | 11/2007 | Geurts | |
| 2010/0001893 | A1 | 1/2010 | Kim et al. | |
| 2010/0281066 | A1* | 11/2010 | Haughawout | G08C 19/28 707/802 |

FOREIGN PATENT DOCUMENTS

| | | | |
|---|---|---|---|
| KR | 10-2008-0069791 | A | 7/2008 |
| KR | 10-2010-0003512 | A | 1/2010 |

* cited by examiner

REMOTE CONTROL DEVICE AND METHOD

TECHNICAL FIELD

The present invention relates to a method of remotely controlling a plurality of electronic devices.

BACKGROUND ART

Generally, a remote control device may be provided to remotely control an operation of an electronic product, for example, a digital television (TV), a digital versatile disk (DVD) player, an audio device, or an air conditioner, for user convenience.

However, because in the related art, a remote control device for exclusive use in each electronic product is used, a plurality of remote control devices need to be required in a single house. Additionally, every time an electronic product is controlled, inconvenience of needing to find and use a remote control device corresponding to the electronic product may be caused.

To avoid the above inconvenience, an integrated remote control device for controlling a plurality of electronic products is disclosed. A scheme of controlling a target device to be controlled using a remote control device may be broadly classified into an infrared ray (IR) and laser communication scheme and a radio frequency (RF) communication scheme.

DISCLOSURE OF THE INVENTION

Technical Goals

An aspect of the present invention provides a remote control device and method that may easily select a specific device from a space in which a plurality of devices are located, and may control the specific device.

Technical Solutions

In one general aspect, there is provided a remote control method including: transmitting a device selecting signal; receiving a response signal from a target device that is to be controlled and that receives the device selecting signal; identifying the target device based on the response signal; changing at least one of an angle of beam spread and a direction of the device selecting signal, when a plurality of target devices to be controlled are identified; and generating a remote control signal based on device control information corresponding to the identified target device, and transmitting the remote control signal to the target device.

In another general aspect, there is provided a remote control method including: transmitting a device selecting signal, in response to at least one of a key input and a voice recognition of a user; receiving a response signal from a target device that is to be controlled and that receives the device selecting signal; identifying the target device based on the response signal; selecting one of a plurality of target devices to be controlled by recognizing a user's voice, when the plurality of target devices are identified; and generating a remote control signal based on device control information corresponding to the identified target device, and transmitting the remote control signal to the target device.

Effects of the Invention

According to embodiments of the present invention, a user may intuitively, simply select a target device to be controlled, and may conveniently control the target device. In particular, the user may accurately select the target device, based on a signal with strong straightness, for example an infrared ray (IR) and a laser.

Additionally, when the target device is selected, a remote control device may be controlled through a radio frequency (RF) communication channel and accordingly, a control signal may not need to be transmitted by avoiding an obstacle. Thus, it is possible for the user to conveniently control the target device.

The remote control device may download and use device information by accessing a device during control, if necessary. Thus, a target device released after manufacturing of the remote control device may also be controlled, and a memory capacity of the remote control device may be efficiently used.

In addition, selection of a plurality of target devices may be prevented by changing a characteristic of a device selecting signal. Thus, it is possible for the user to accurately, easily select a desired device.

BEST MODE FOR CARRYING OUT THE INVENTION

The following detailed description is provided in order to explain a remote control device and method according to embodiments of the present invention by referring to the figures.

Figure 1:
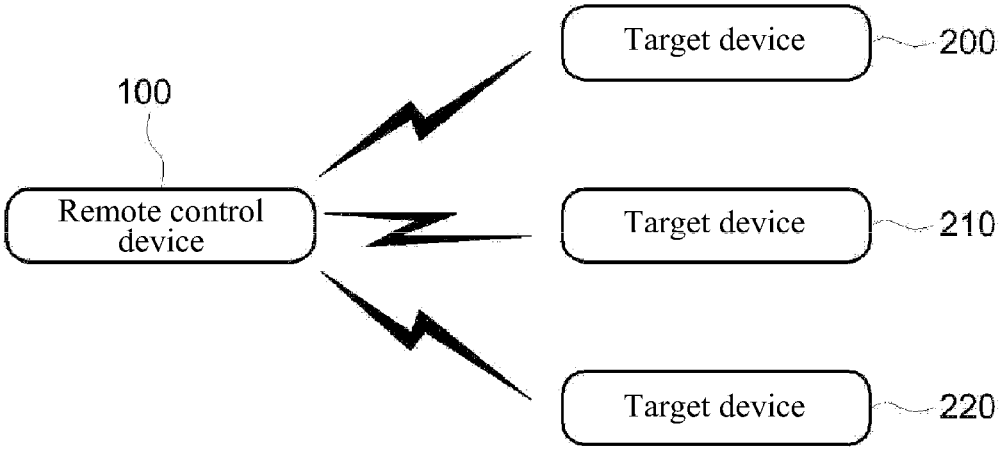
FIG. 1 is a block diagram illustrating a configuration of a remote control system according to an embodiment of the present invention.

FIG. 1 is a block diagram illustrating a configuration of a remote control system according to an embodiment of the present invention. The remote control system of FIG. 1 may include a remote control device 100, and a plurality of target devices to be controlled, for example, devices 200 through 220. In the present disclosure, a target device to be controlled may be referred to as a target device.

Referring to FIG. 1, the remote control device 100 may perform a function of transmitting a remote control signal corresponding to a control command input by a user to the target device 200 and remotely controlling the target device 200.

The remote control device 100 may be implemented as a dedicated device having only a remote control function, or may be implemented by adding a remote control function to a personal device, for example, a mobile phone, a personal digital assistant (PDA), a digital multimedia broadcasting (DMB) terminal, and the like.

Additionally, the target device 200 may include, for example, various electronic devices, for example, a television (TV), an air conditioner, a video tape recorder (VTR), a refrigerator, an electric lamp, a printer, a monitor, a personal computer (PC), and the like. The target device 200 may operate based on a control signal received from the remote control device 100.

Figure 2:
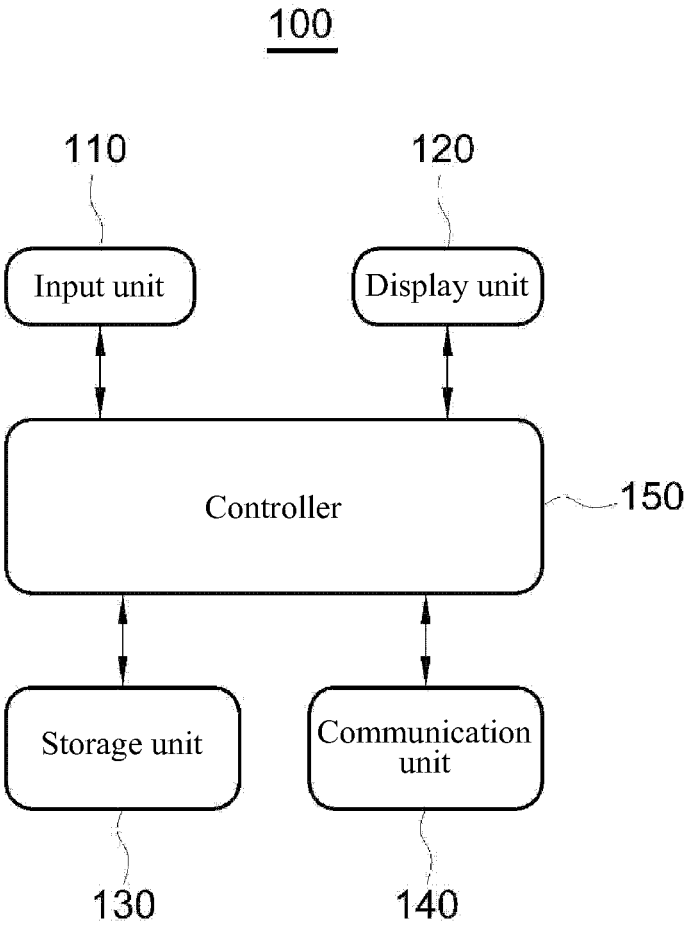
FIG. 2 is a block diagram illustrating an example of a configuration of a remote control device according to an embodiment of the present invention.

Referring to FIG. 2, the remote control device 100 may include an input unit 110, a display unit 120, a storage unit 130, a communication unit 140, and a controller 150.

The input unit 110 may be implemented as a keypad or a touch pad including number keys, letter keys, various special keys, and the like. The input unit 110 may receive an input of various commands to control the target device 200 from a user, and may transfer the commands to the controller 150.

Additionally, the input unit 110 may include a special key (hereinafter, referred to as a "device selection key") to allow a user to determine whether a device selecting signal is to be transmitted. When a user selects the device selection key, the target device 200 may be selected as a device to be controlled, by transmitting a device selecting signal to the target device 200, instead of performing a complex menu operation.

The display unit 120 may display a control menu to control the target device 200. The control menu may include a menu item corresponding to a characteristic of a corresponding target device.

For example, when the selected target device 200 is a TV, the control menu may include menu items to control a volume, a channel, and the like. When the selected target device 200 is an air conditioner, the control menu may include menu items to control a temperature, a wind direction, an air volume, and the like.

A user may verify a control menu using the display unit 120, and may input a control command to operate the target device 200 based on a user's desire using the input unit 110.

The display unit 120 may display status information of the target device 200. The status information may refer to information associated with an operation of a corresponding target device, and may include, for example, a current set temperature of an air conditioner, a charge state of a cordless phone, or information on a compact disc (CD) that is currently being played back in an audio device. The display unit 120 may also display a variety of information associated with use of the remote control device 100.

The display unit 120 may be implemented as a flat panel display, for example, a liquid crystal display (LCD), an organic light emitting diode (OLED), a plasma display, and the like.

The storage unit 130 may perform a function of storing data and various programs required to perform an operation of the remote control device 100. For example, the storage unit 130 may store device control information downloaded from the target device 200. The storage unit 130 may be implemented as a memory unit, for example, a random access memory (RAM), a read only memory (ROM), a hard disk, a flash memory, and the like.

The device control information may include a variety of information required to control the target device 200. The device control information may include, for example, a product identification code used to identify products, control menu information used to display a control menu on a screen, a control code that is transmitted to the target device 200 based on a control command input by a user and that is used to control a corresponding device, and the like.

The device control information may be provided in advance by a manufacturer of a target device, and may be stored in advance in the storage unit 130 or may be downloaded by accessing the target device 200 if necessary.

Additionally, the device control information may be provided in a form of a virtual machine (VM) application written in C, C++, Java, mobile flash, and the like.

The communication unit 140 may wirelessly transmit and receive a variety of information to and from the target device 200. For example, based on control of the controller 150, the communication unit 140 may transmit a device selecting signal to the target device 200, and may receive a response signal corresponding to the device selecting signal.

Additionally, the communication unit 140 may transmit a remote control signal to the target device 200, based on the control of the controller 150.

The communication unit 140 may receive, from the target device 200, device control information or device status information, and may transfer the device control information or the device status information to the controller 150.

The communication unit 140 may be implemented as a communication module to transmit and receive a signal using a communication scheme with strong straightness (or directivity). For example, the communication unit 140 may be implemented as an infrared ray (IR) communication module, or a laser communication module. When a radio frequency (RF) communication scheme is used, the communication unit 140 may be implemented as a communication module employing a directional antenna.

As described above, the communication unit 140 may be implemented as a module to transmit and receive a signal using a communication scheme with strong straightness and accordingly, a user may set a signal transmission direction of the communication unit 140 to a direction towards the target device 200 the user desires to control, and may press a device selection key. Thus, a device selecting signal may be transmitted to a desired target device among the devices 200 through 220, instead of performing a complex operation.

Because an IR signal or a laser signal has strong straightness, a user may control the device selecting signal to be accurately transmitted to only a desired target device among a plurality of target devices.

The controller 150 may control an overall operation of the remote control device 100, in response to a command input by a user. When a response signal is received from the target device 200, the controller 150 may identify the target device 200 based on a product identification code included in the received response signal, and may determine whether the target device 200 is registered in advance.

When the target device 200 is determined to be unregistered, the controller 150 may download device control information associated with the target device 200 from the target device 200, may store the device control information in the storage unit 130, and may register the target device 200.

Additionally, the controller 150 may display a control menu on the display 110, based on the downloaded device control information, and may allow a control command to be received from the user through the input unit 110.

The controller 150 may control the communication unit 140 to generate a control signal corresponding to a control command input by the user and to transmit the control signal to the target device 200. For example, when a device status information verification command is input by the user, the controller 150 may transmit a control signal to request device status information to the target device 200, and may display the device status information provided by the target device 200 on the display unit 120 so as to provide the user with the device status information.

Hereinafter, an operation of a remote control device according to an embodiment of the present invention will be further described with reference to FIGS. 3 and 4.

Figure 3:
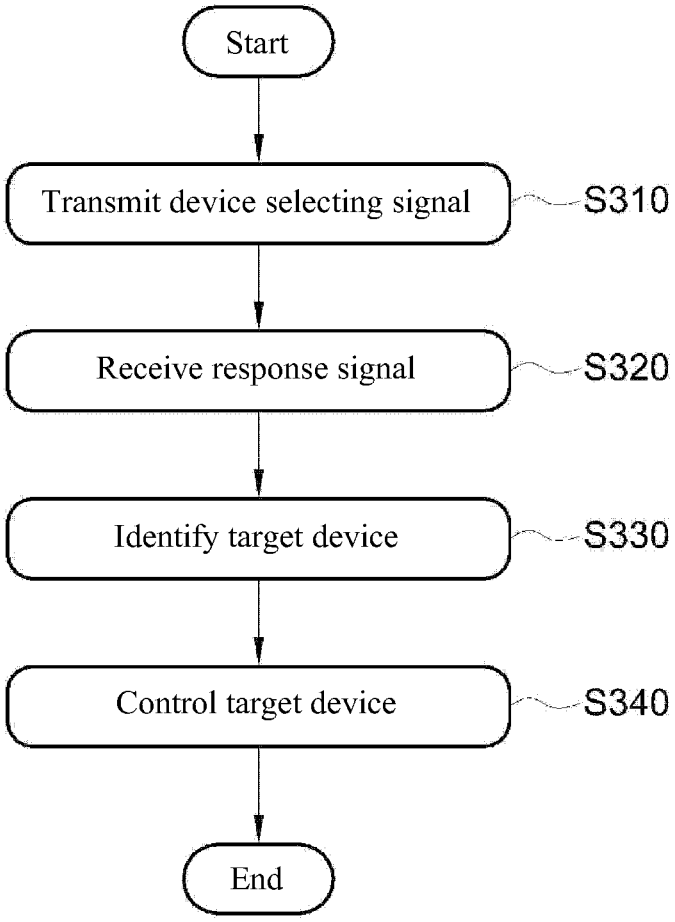
FIG. 3 is a flowchart illustrating a remote control method according to an embodiment of the present invention.
Figure 4:
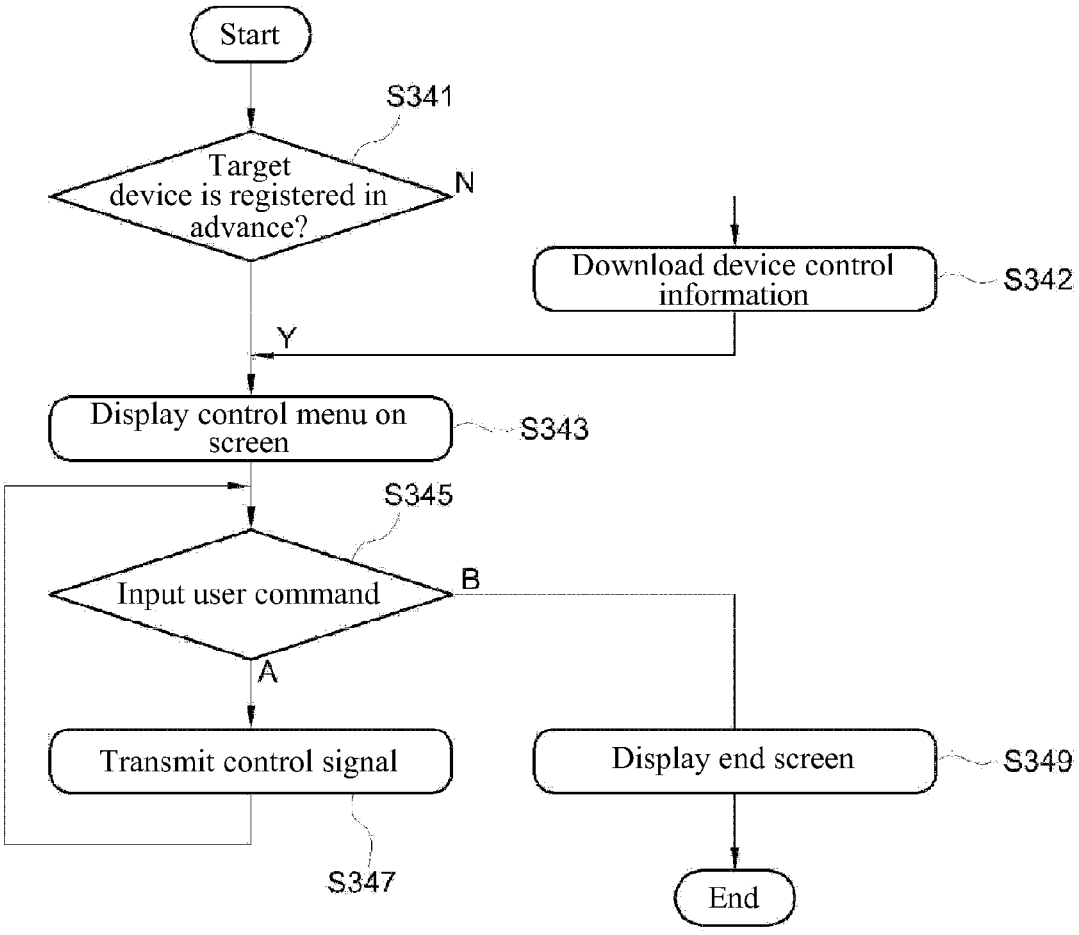
FIG. 4 is a flowchart illustrating an operation of controlling a target device in the method of FIG. 3.

FIG. 3 is a flowchart illustrating a remote control method according to an embodiment of the present invention. The remote control method is described with reference to FIGS. 1 and 2.

Referring to FIG. 3, when a user sets a signal transmission direction of the communication unit 140 in the remote control device 100 to a direction towards the target device 200, and presses a device selection key using the input unit 110, the controller 150 may transmit a device selecting signal to the target device 200 via the communication unit 140 in operation S310.

For example, an IR transmitter (not shown) included in the communication unit 140 may transmit an IR signal having strong straightness with a predetermined angle of beam spread, in response to selection of the device selection key. The IR signal may include information on the remote control device 100.

The information on the remote control device 100 may be, for example, identification information used to connect the remote control device 100 and the target device 200 that receives the IR signal, using an RF communication scheme. The RF communication scheme may include, for example, a wireless local area network (WLAN) (for example, wireless-fidelity (Wi-Fi)), Bluetooth, ZigBee, or a near field communication (NFC).

When the target device 200 receives the device selecting signal and transmits a response signal, the communication unit 140 may receive the response signal, and may transfer the response signal to the controller 150 in operation S320.

For example, the target device 200 may extract identification information on the remote control device 100 from an IR signal received from the remote control device 100, and may connect an RF communication network to the remote control device 100, based on the extracted identification information.

The target device 200 may transmit the response signal to the remote control device 100, using the connected RF communication network.

The controller 150 in the remote control device 100 may identify the target device 200, based on a product identification code included in the received response signal in operation S330.

The controller 150 may generate a control signal corresponding to a control command input by the user, based on device control information on the identified target device 200, and may transmit the control signal to the target device 200 to control the target device 200 in operation S340.

For example, the control signal may be transmitted and received between the remote control device 100 and the target device 200 via the RF communication network connected in operation S320.

Hereinafter, operation S340 of controlling the target device 200 is further described with reference to FIG. 4. When the target device 200 is identified in operation S330, the controller 150 may determine whether the target device 200 is registered in advance in the remote control device 100 in operation S341.

When the target device 200 is determined to be registered in advance (S341: Y), the controller 150 may display a control menu on a screen, based on control information associated with a corresponding device stored in the storage unit 130 in operation S343.

When the target device 200 is determined to be unregistered (S341: N), the controller 150 may download device control information from the target device 200, may store the device control information in operation S342, and may display a control menu on a screen, based on the stored device control information in operation S343.

When the user inputs a control command to control a target device on the control menu (S345: A), the controller 150 may generate a control signal corresponding to the control command input by the user, and may transmit the control signal to the target device 200 via the communication unit 140 in operation S347.

When the user inputs an end command (S345: B), the controller 150 may display an end screen indicating that a control operation is terminated on the display unit 120, and may terminate a remote control operation in operation S349.

The remote control device 100 may transmit and receive a signal using only a communication scheme with strong straightness, as described above, however, there is no limitation thereto. The device selecting signal may be transmitted using a communication scheme with strong straightness, and a remote control signal and device control information may be transmitted and received using a communication scheme with weak straightness, for example, a nondirectional communication scheme.

Figure 5:
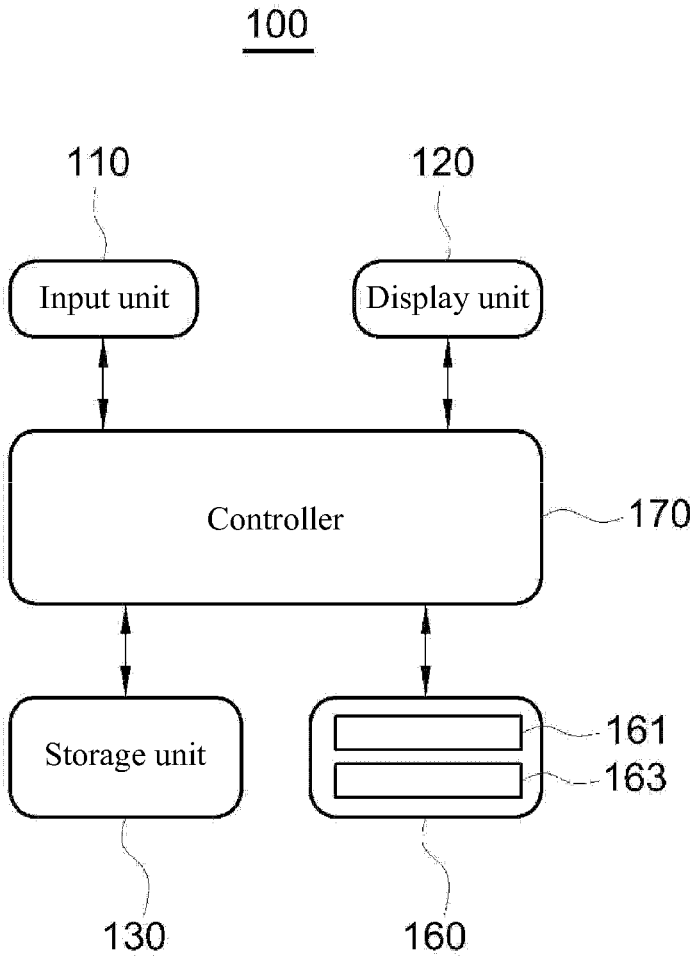
FIG. 5 is a block diagram illustrating another example of a configuration of a remote control device according to an embodiment of the present invention.

FIG. 5 is a block diagram illustrating a configuration of a remote control device according to an embodiment of the present invention. The above-description of FIGS. 1 through 4 is also applicable to a configuration and an operation of a remote control device 100 of FIG. 5 and accordingly, will not be repeated here.

Referring to FIG. 5, a communication unit 160 may wirelessly transmit and receive a variety of information to and from the target device 200. To this end, the communication unit 160 may include a first communication module 161 and a second communication module 163.

The first communication module 161 may be implemented as a communication module to transmit a signal using a communication scheme with strong directivity, and may transmit a device selecting signal to the target device 200 using the communication scheme with strong directivity.

For example, the first communication module 161 may be implemented as an IR communication module or a laser communication module. When an RF communication scheme is used, the first communication module 161 may be implemented as a communication module employing a directional antenna.

The second communication module 163 may be implemented as a module to transmit and receive a signal using a communication scheme with weak straightness in comparison to the first communication module 161. The second communication module 163 may transmit a remote control signal to the target device 200, and may receive, from the target device 200, a response signal, device control information or device status information. Accordingly, the second communication module 163 may be implemented as a nondirectional RF communication module.

A controller 170 may control an overall operation of the remote control device 100. For example, when a user presses a device selection key, the controller 170 may control the first communication module 161 to transmit a device selecting signal.

Additionally, when the second communication module 163 receives a response signal from the target device 200, the controller 170 may control the second communication module 163, may set an RF communication channel with the target device 200, and may determine whether the target device 200 is registered in advance.

When the target device 200 is determined to be unregistered, the controller 170 may download device control information from the target device 200 via the RF communication channel, may store the device control information in a storage unit 130, and may register a corresponding device.

Additionally, the controller 170 may display a control menu on a display 110, based on the downloaded device control information, may receive a control command input by the user, may generate a control signal corresponding to the control command, and may transmit the control signal to the target device 200 via the RF communication channel.

For example, when a device status information verification command is input by the user, the controller 170 may transmit a control signal to request device status information to the target device 200, and may display the device status information provided by the target device 200 on the display unit 120, so as to provide the user with the device status information.

The remote control device 100 may include a VM (not shown) to execute a VM application written in C, C++, Java, mobile flash, and the like. When device control information is provided in the form of a VM application, the VM may execute the VM application, may display a control menu on a screen, and may receive a control command input by a user.

The VM may be implemented by a platform, for example, a general virtual machine (GVM), an extended virtual machine (XVM), a binary runtime environment for wireless (BREW), a K virtual machine (KVM), a wireless Internet terminal open platform (WITOP), a wireless Internet platform for interoperability (WIPI), and the like.

Figure 6:
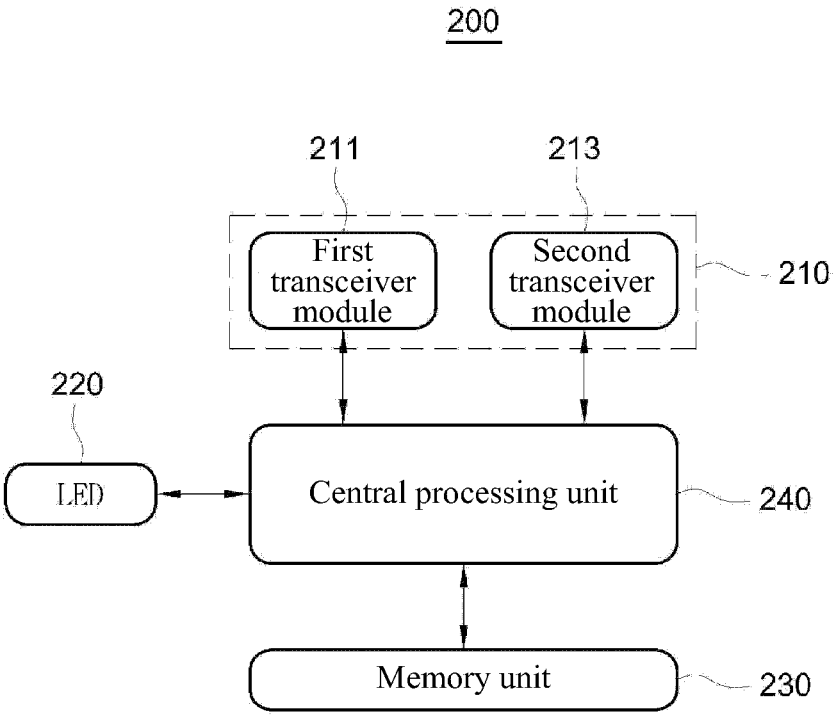
FIG. 6 is a block diagram illustrating a configuration of a target device according to an embodiment of the present invention.

FIG. 6 is a block diagram illustrating a configuration of a target device according to an embodiment of the present invention. A target device 200 of FIG. 6 may include a transceiver 210, a memory unit 230, and a central processing unit 240. Depending on embodiments, the target device 200 may further include an LED 220.

Referring to FIG. 6, the transceiver 210 may wirelessly transmit and receive a variety of information to and from the remote control device 100, may receive a device selecting signal from the remote control device 100, and may transmit a response signal corresponding to the device selecting signal.

Additionally, the transceiver 210 may receive a remote control signal from the remote control device 100, and may transmit device control information and device status information.

The response signal may include a device identification code and accordingly, the remote control device 100 may identify a device that transmits a response signal.

The memory unit 230 may store device control information used to control the target device 200. In response to a request of the remote control device 100, the memory unit 230 may receive an instruction from the central processing unit 240, and may transfer the device control information.

The central processing unit 240 may control an overall operation of the target device 200. When a device selecting signal is received from the remote control device 100, the central processing unit 240 may allow the LED 220 to flicker during a predetermined period of time, and may control the transceiver 210 to transmit a response signal to the remote control device 100.

Additionally, the central processing unit 240 may transmit device control information or device status information, in response to a request of the remote control device 100, and may control the target device 200 to perform an operation corresponding to the control signal received from the remote control device 100.

The LED 220 may flicker during a predetermined period of time based on control of the central processing unit 240, to indicate whether the device selecting signal is received. Accordingly, the user may verify that the device selecting signal is accurately transmitted to a desired target device 200.

The transceiver 210 may include a first transceiver module 211, and a second transceiver module 213.

The first transceiver module 211 may be implemented as an IR communication module or a laser communication module, to receive a device selecting signal using a communication scheme with strong directivity. When an RF communication scheme is used, the first transceiver module 211 may be implemented as a communication module employing a directional antenna.

The second transceiver module 213 may be implemented as an RF communication scheme to transmit and receive a signal using a communication scheme with weak straightness. The second transceiver module 213 may transmit a response signal, device control information, and device status information to the remote control device 100, and may receive a remote control signal from the remote control device 100.

For example, the second transceiver module 213 may broadcast the response signal using the RF communication scheme, based on control of the central processing unit 240. When the response signal is transmitted, the second transceiver module 213 may set an RF communication channel with the remote control device 100, and may perform two-way communication.

The second transceiver module 213 may transmit device control information, status information, and the like to the remote control device 100 via the RF communication channel, may receive various remote control signals from the remote control device 100, and may transfer the remote control signals to the central processing unit 240.

Hereinafter, examples of a method of selecting one of a plurality of target devices will be further described with reference to FIGS. 7 through 10.

Figure 7:
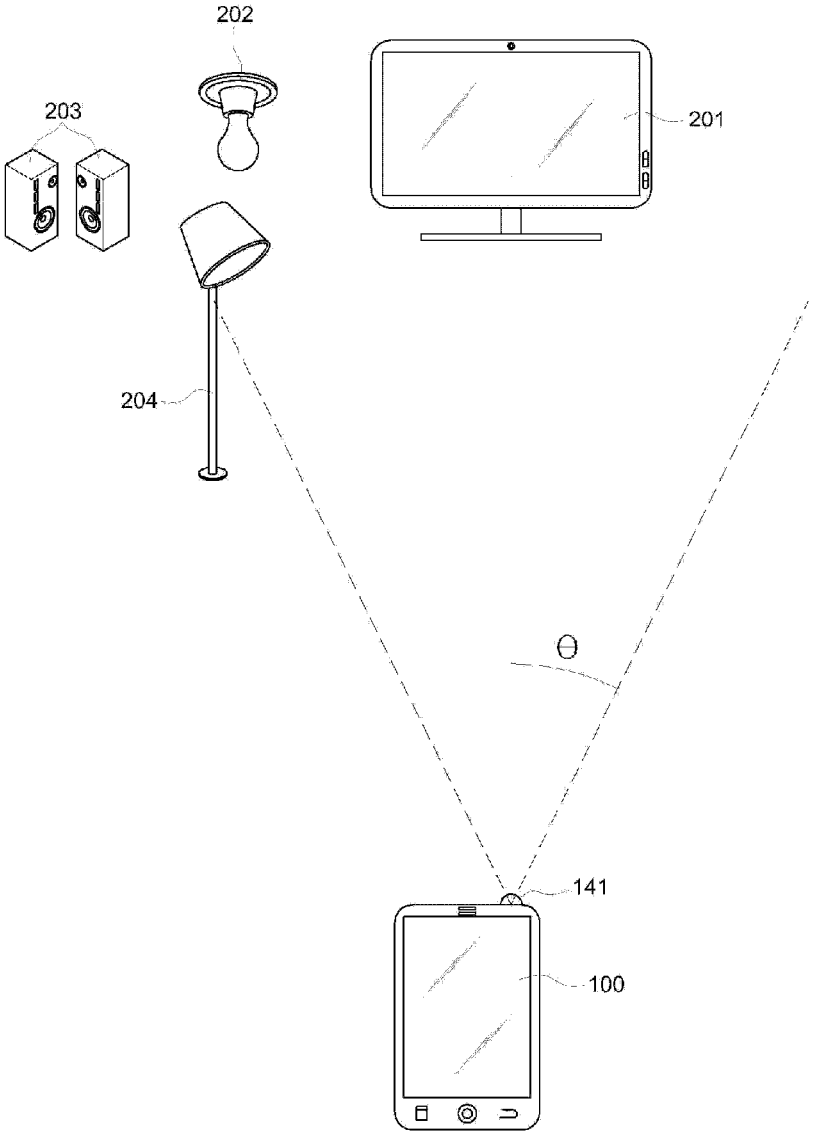
FIG. 7 is a diagram illustrating an example of a method of selecting one of a plurality of target devices according to an embodiment.

FIG. 7 is a diagram illustrating a method of selecting one of a plurality of target devices according to an embodiment.

Referring to FIG. 7, devices 201 through 204 that are controllable by the remote control device 100 based on the operations described above with reference to FIGS. 1 through 6 may be disposed adjacent to each other in a space.

An IR transmitter 141 included in the remote control device 100 may transmit, as a device selecting signal, an IR signal with straightness based on a direction in which the remote control device 100 faces. The transmitted IR signal may have a predetermined angle of beam spread θ.

When target devices are located adjacent to each other within the angle of beam spread θ of the IR signal, at least two devices may receive the device selecting signal, based on the angle of beam spread θ.

For example, in FIG. 7, a TV 201, an electric lamp 202, and a desk lamp 204 may receive the device selecting signal from the remote control device 100.

In this example, each of the TV 201, the electric lamp 202, and the desk lamp 204 may transmit a response signal in response to the device selecting signal. Accordingly, a plurality of devices other than the TV 201 a user desires to select, that is, the electric lamp 202 and the desk lamp 204 may be selected.

In each of the TV 201, the electric lamp 202, and the desk lamp 204 that receive the device selecting signal, an indicator including a light emitting element, for example, an LED may flicker during a predetermined period of time and accordingly, the user may recognize that a plurality of devices are selected.

Thus, the user may need to perform an additional operation of selecting a device that the user desires to control from among the selected devices.

When a plurality of target devices are located adjacent to each other, a specific device that the user desires to control may be easily selected by adjusting a characteristic of a device selecting signal transmitted from the remote control device 100, for example, an angle of beam spread, a direction or a distance.

Figure 8:
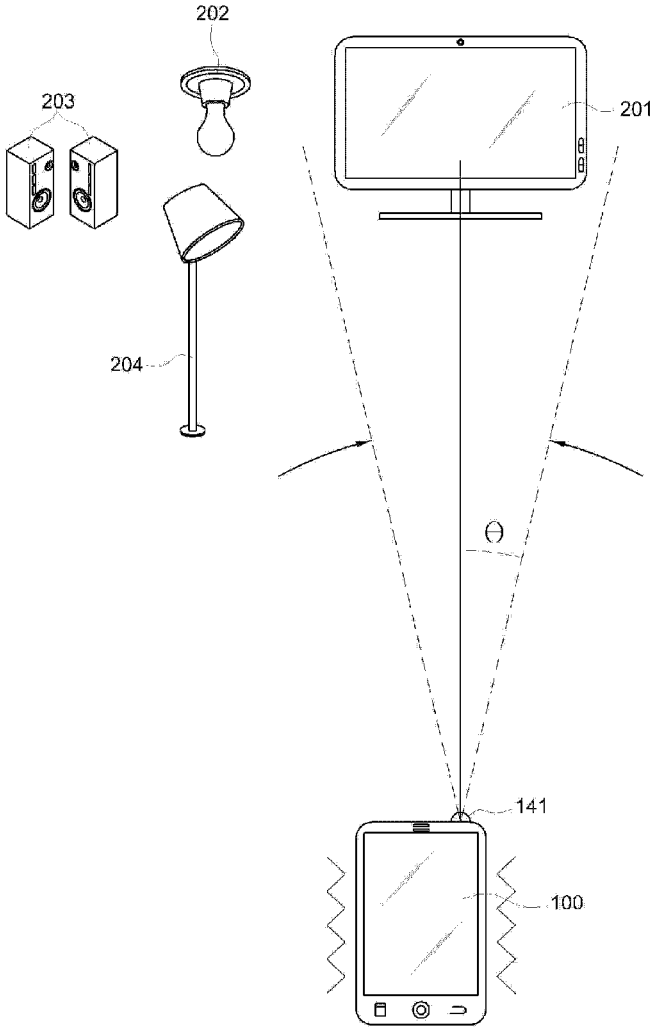
FIG. 8 is a diagram illustrating a method of selecting a specific target device by adjusting an angle of beam spread of a device selecting signal according to an embodiment.

FIG. 8 is a diagram illustrating a method of selecting a specific target device by adjusting an angle of beam spread of a device selecting signal according to an embodiment.

Referring to FIG. 8, when a plurality of devices (for example, a TV 201, an electric lamp 202, and a desk lamp 204) are selected by a user, as shown in FIG. 7, the remote control device 100 may adjust an angle of beam spread θ of the IR signal.

For example, when each of the TV 201, the electric lamp 202 and the desk lamp 204 receives an IR signal from the remote control device 100, the remote control device 100 may receive a response signal from each of the devices, and may recognize that at least two devices are selected.

In this example, the controller 150 of the remote control device 100 may control an IR transmitter 141 to reduce the angle of beam spread θ of the IR signal.

The controller 150 may request a device that receives the IR signal to transmit a response signal, while reducing the angle of beam spread θ of the IR signal at a predetermined interval and transmitting the IR signal.

The angle of beam spread θ of the IR signal may continue to decrease until a response signal is received from a single device. In FIG. 8, until only a response signal is received from the TV 201, the angle of beam spread θ of the IR signal may decrease.

According to another embodiment of the present invention, the user may adjust the angle of beam spread θ of the IR signal.

For example, when the user sets the remote control device 100 to face the TV 201, and presses a device selection key, and when an LED of each of the electric lamp 202 and the desk lamp 204 as well as an LED of the TV 201 flickers, the user may reduce the angle of beam spread θ of the IR signal by pressing a (−) key of the remote control device 100.

When the user verifies flickering of only the LED of the TV 201 and releases the pressed (−) key, only the TV 201 may be selected from among the plurality of devices, and the control operation described above with reference to FIGS. 1 through 6 may be performed by the remote control device 100.

The above-described angle of beam spread θ of the IR signal may be adjusted, by adjusting a current supplied to the IR transmitter 141 using an application installed in the remote control device 100, or by mechanically changing an optical structure of the IR transmitter 141.

For example, the IR transmitter 141 may include an IR generator (not shown) and a lens for IR radiation (not shown). By changing a structure of the lens may be changed, or by moving the lens, an angle of beam spread θ of an IR signal transmitted from the IR transmitter 141 may be adjusted.

When the angle of beam spread θ of the IR signal is initially set to a low value, a single device may not be selected by pressing a device selection key. Accordingly, the angle of beam spread θ may be initially set to a sufficiently high value, and may desirably be gradually reduced when a plurality of devices are selected.

Conversely, when a device is not selected by a user pressing a device selection key, the controller 150 or the user may gradually increase the angle of beam spread θ of the IR signal until a single device is selected.

Figure 9:
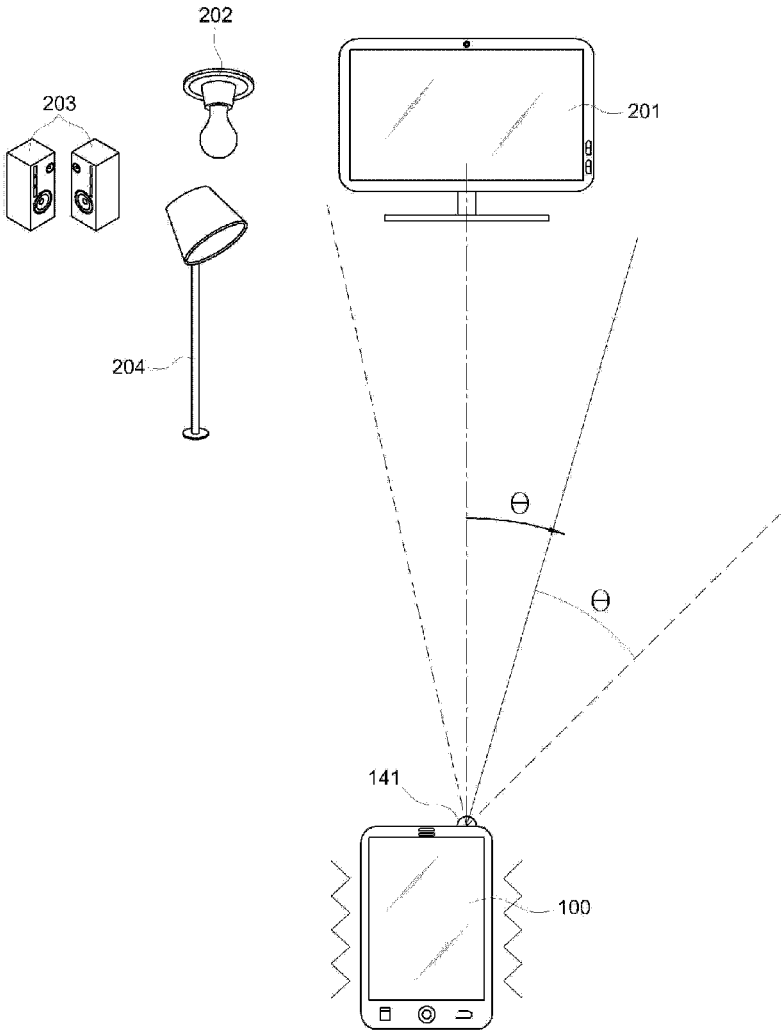
FIG. 9 is a diagram illustrating a method of selecting a specific target device by adjusting a direction of a device selecting signal according to an embodiment.

FIG. 9 is a diagram illustrating a method of selecting a specific target device by adjusting a direction of a device selecting signal according to an embodiment.

Referring to FIG. 9, when a plurality of devices (for example, a TV 201, an electric lamp 202, and a desk lamp 204) are selected by a user, as shown in FIG. 7, the remote control device 100 may adjust a direction Φ of the IR signal.

For example, when each of the TV 201, the electric lamp 202 and the desk lamp 204 receives an IR signal from the remote control device 100, the remote control device 100 may receive a response signal from each of the devices, and may recognize that at least two devices are selected.

In this example, the controller 150 of the remote control device 100 may control an IR transmitter 141 to change the direction Φ of the IR signal.

The controller 150 may request a device that receives the IR signal to transmit a response signal, while changing the direction Φ of the IR signal to a right direction at a predetermined interval and transmitting the IR signal.

The direction Φ of the IR signal may continue to be changed to the right direction or the left direction, until a response signal is received from a single device. In FIG. 9, the direction Φ of the IR signal may be changed, until only a response signal is received from the TV 201.

According to another embodiment of the present invention, the user may adjust the direction Φ of the IR signal.

For example, when the user sets the remote control device 100 to face the TV 201, and presses a device selection key, and when an LED in each of the electric lamp 202 and the desk lamp 204 as well as an LED of the TV 201 flickers, the user may change the direction Φ of the IR signal by pressing a (+) key or (−) key of the remote control device 100.

When the user verifies flickering of only the LED of the TV 201 and releases the pressed (+) key or (−) key, only the TV 201 may be selected from among the plurality of devices, and the control operation described above with reference to FIGS. 1 through 6 may be performed by the remote control device 100.

The adjusting of the direction Φ of the IR signal as described above may include adjusting a direction Φ of an IR signal transmitted from the IR transmitter 141 by mechanically changing a direction in which a lens for IR radiation included in the IR transmitter 141 faces.

Conversely, when a device is not selected by a user pressing a device selection key, the controller 150 or the user may change the direction Φ of the IR signal to the right direction or the left direction, until a single device is selected.

According to another embodiment of the present invention, a specific device may be selected by adjusting a distance between the remote control device 100 and a target device.

Figure 10:
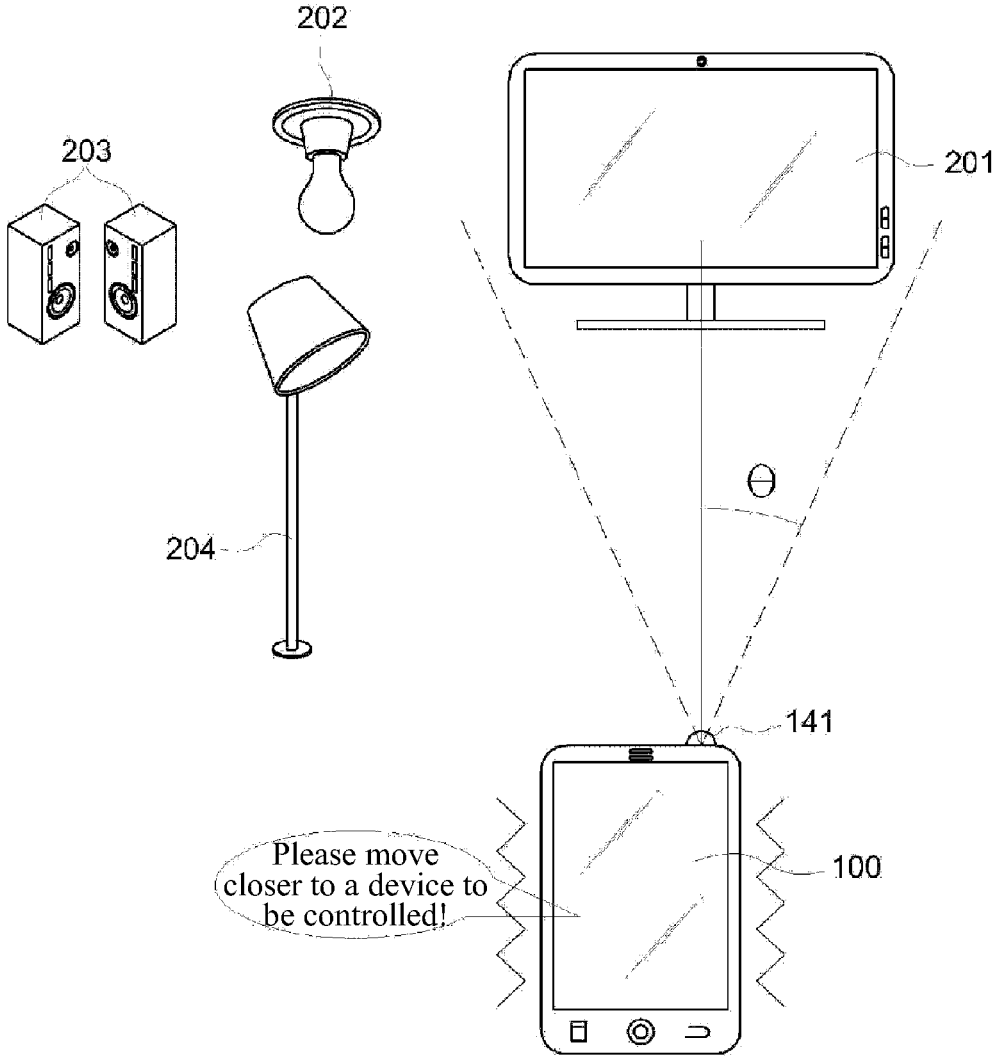
FIG. 10 is a diagram illustrating a configuration of a user interface (UI) to select a specific target device according to an embodiment.

FIG. 10 is a diagram illustrating a configuration of a user interface (UI) to select a specific target device according to an embodiment.

Referring to FIG. 10, when a plurality of devices (for example, a TV 201, an electric lamp 202, and a desk lamp 204) are selected by a user, as shown in FIG. 7, the remote control device 100 may recognize that the devices are selected, and may provide the user with information on the selected devices, using an image, a voice, a vibration, and the like.

In this example, when a distance between the remote control device 100 and a target device decreases, only a single device may receive an IR signal and may be selected.

To induce the above decrease in the distance, the remote control device 100 may inform the user of a command to move closer to a device to be controlled, using an image or sound. The command may continue to inform the user until only a response signal is received from the TV 201.

The remote control device 100 may transmit an IR signal and may select one of a plurality of target devices, as described above with reference to FIGS. 7 through 10, however, there is no limitation thereto. Accordingly, various signals with straightness other than the IR signal may be used to select a target device, and the above control method may also be applicable to the various signals.

Hereinafter, examples of a method of selecting a target device from among a plurality of target devices and controlling the selected target device will be further described with reference to FIGS. 11 through 16.

Figure 11:
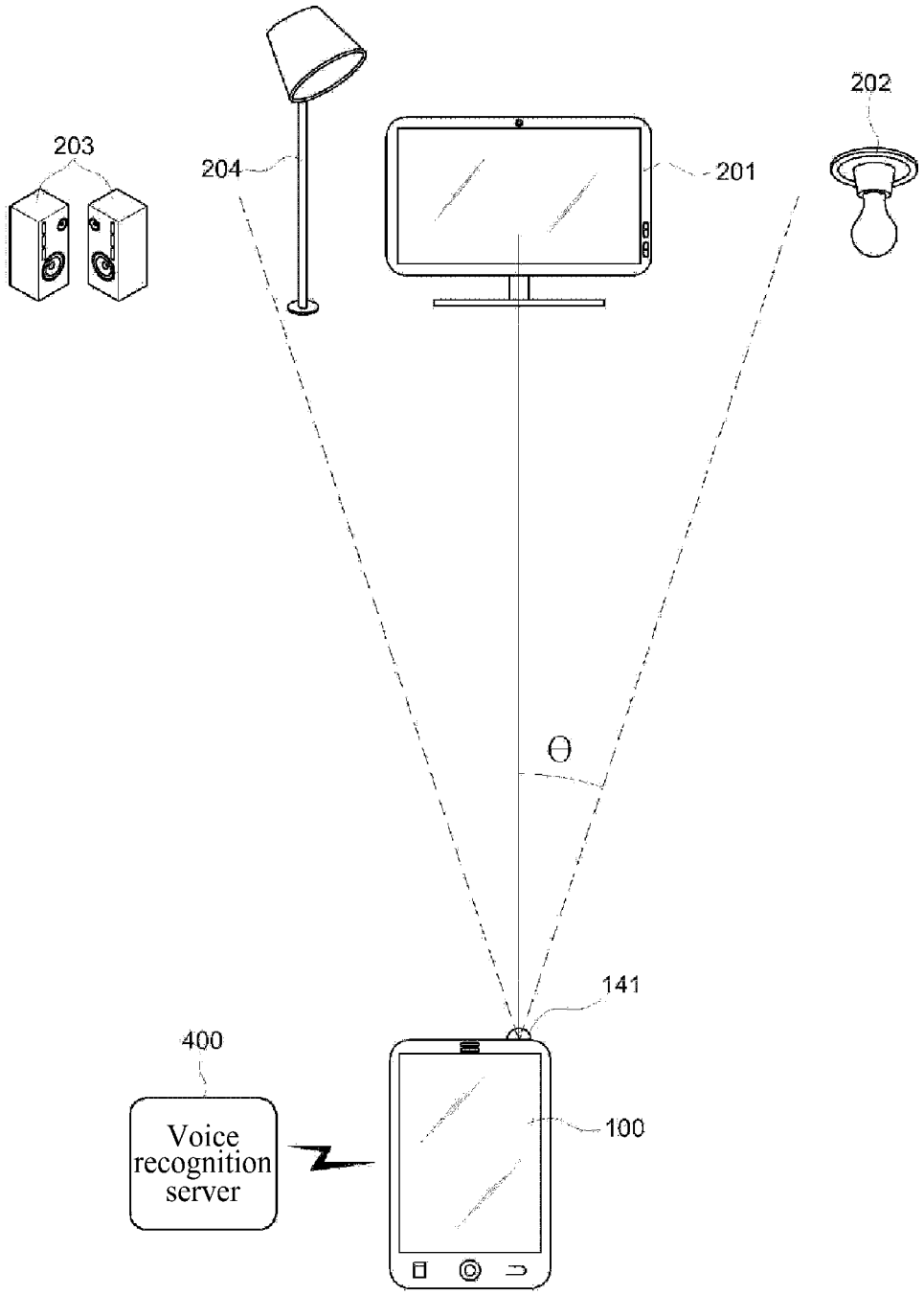
FIG. 11 is a diagram illustrating an example of a method of selecting one of a plurality of target devices according to an embodiment.

FIG. 11 is a diagram illustrating a method of selecting one of a plurality of target devices according to an embodiment.

Referring to FIG. 11, devices 201 through 204 that are controllable by the remote control device 100 based on the operations described above with reference to FIGS. 1 through 6 may be disposed adjacent to each other in a space.

An IR transmitter 141 included in the remote control device 100 may transmit, as a device selecting signal, an IR signal with straightness based on a direction in which the remote control device 100 faces, and the transmitted IR signal may have a predetermined angle of beam spread θ.

When target devices are located adjacent to each other within the angle of beam spread θ of the IR signal, at least two devices may receive the device selecting signal, based on the angle of beam spread θ.

For example, in FIG. 11, a TV 201 and a desk lamp 204 may receive the device selecting signal from the remote control device 100.

In this example, each of the TV 201 and the desk lamp 204 may transmit a response signal in response to the device selecting signal. Accordingly, the desk lamp 204 together with the TV 201 a user desires to select may be selected.

In each of the TV 201 and the desk lamp 204 that receive the device selecting signal, an indicator including a light emitting element, for example, an LED may flicker during a predetermined period of time and accordingly, the user may recognize that a plurality of devices are selected.

Thus, the user may need to perform an additional operation of selecting a device that the user desires to control from among the selected devices.

When a plurality of target devices are located adjacent to each other, a specific device that the user desires to control may be easily selected based on at least one of a key input and voice of the user input to the remote control device 100.

As described above with reference to FIG. 11, when a plurality of devices receive an IR signal, the remote control device 100 may receive a response signal from each of the devices using an RF communication scheme. The received response signal may include identification information, control program information, and the like of each of the devices.

The remote control device 100 may transmit the received control program information to the voice recognition server 400 via the communication unit 140, using a network, for example, a wireless Internet, and the like. The voice recognition server 400 may interpret a user command based on the received control program information.

Accordingly, when the remote control device 100 receives a response signal including control program information and information on a target device, based on an IR signal, and when a plurality of target devices are selected, the user may select a final target device through voice recognition or key input.

Hereinafter, an example in which the remote control device 100 is a portable terminal will be described, however, there is no limitation thereto. Embodiments of the present invention may be applicable to various devices capable of recognizing a user's voice by accessing the voice recognition server 400 and executing a user command.

FIGS. 12 through 15 each illustrate a UI screen of a voice recognition program, to describe a method of selecting a specific target device using voice recognition and controlling the specific target device according to a first embodiment.

Figure 12:
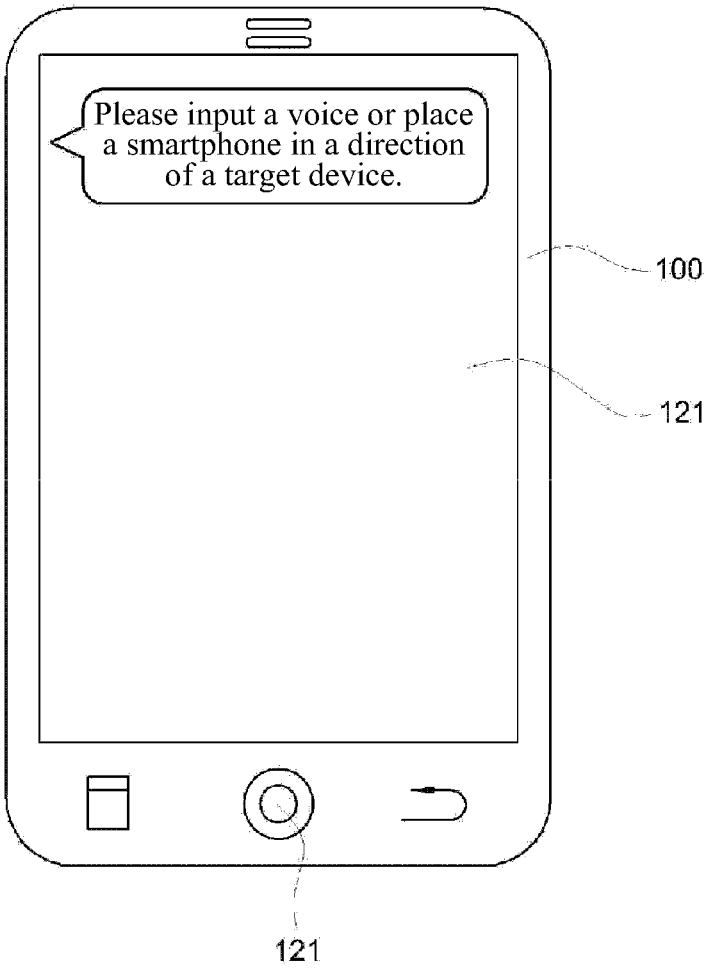
FIGS. 12 through 15 are diagrams illustrating an example of a method of selecting a specific target device using voice recognition and controlling the specific target device according to a first embodiment.

Referring to FIG. 12, when a voice recognition mode is executed in the remote control device 100, the remote control device 100 may search for controllable devices by transmitting an IR signal using the same method as described above with reference to FIGS. 1 through 7, while waiting for a voice input of a user using a microphone (not shown).

A user may request a desired function using the remote control device 100 in a voice, or may place the remote control device 100 in a direction that the user desires to control the remote control device 100.

For example, when the user places the remote control device 100 to face the TV 201, as shown in FIG. 7, the remote control device 100 may receive a response signal including device identification information and control program information from each of the TV 201 and the desk lamp 204, based on the angle of beam spread θ of the IR signal.

In this example, the remote control device 100 may recognize that a plurality of devices, that is, the TV 201 and the desk lamp 204 are selected, based on the received response signal.

Figure 13:
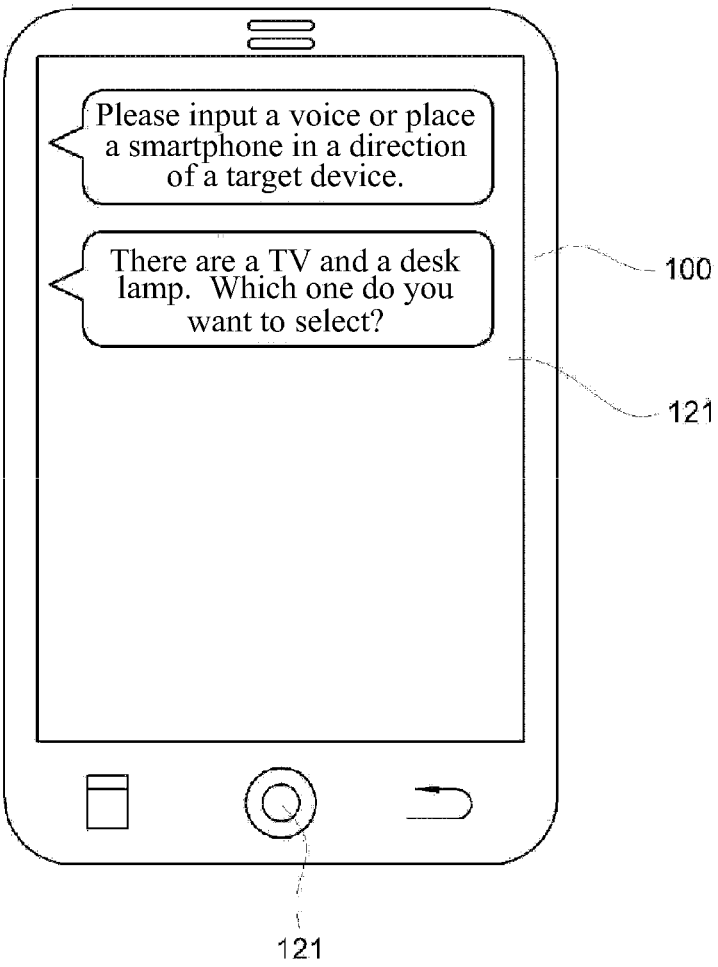

Current controllability of the selected TV 201 and the selected desk lamp 204 may be displayed on a screen 121 of the remote control device 100, in response to the IR signal, as shown in FIG. 13.

The remote control device 100 may transfer the device identification information and the control program information received from each of the TV 201 and the desk lamp 204 to a voice recognition server 400 via the communication unit 140, and may allow a voice control command input by the user to be interpreted by the voice recognition server 400.

Figure 14:
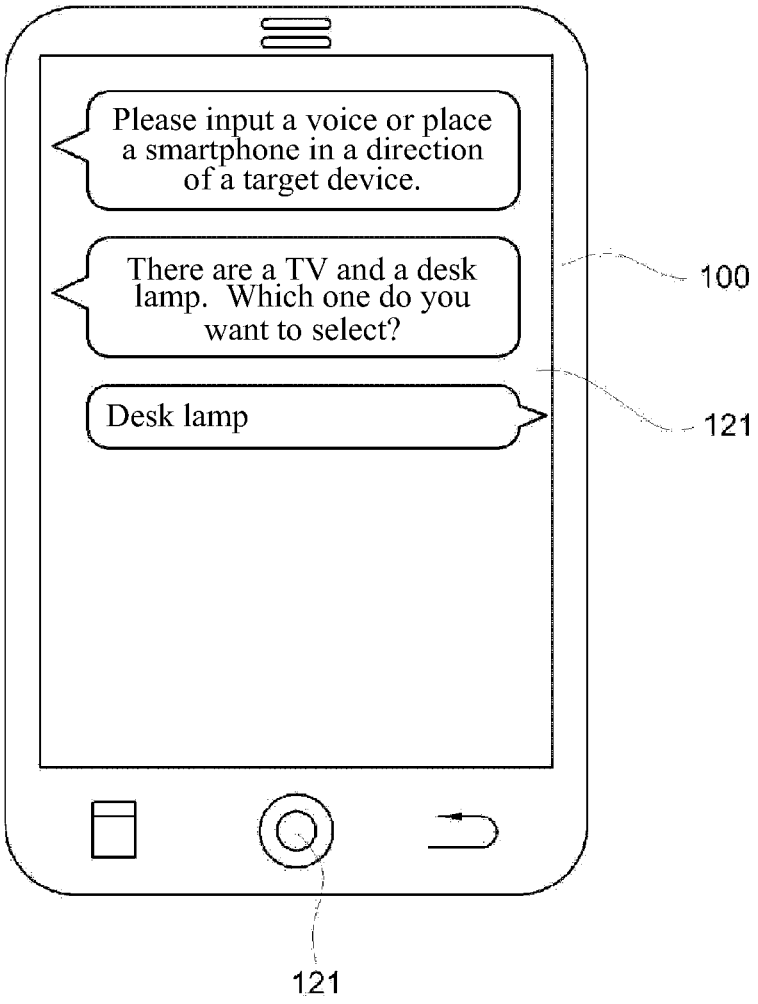

Referring to FIG. 14, the user may finally select one of controllable devices, for example, the desk lamp 204, as a device to be controlled.

Figure 15:
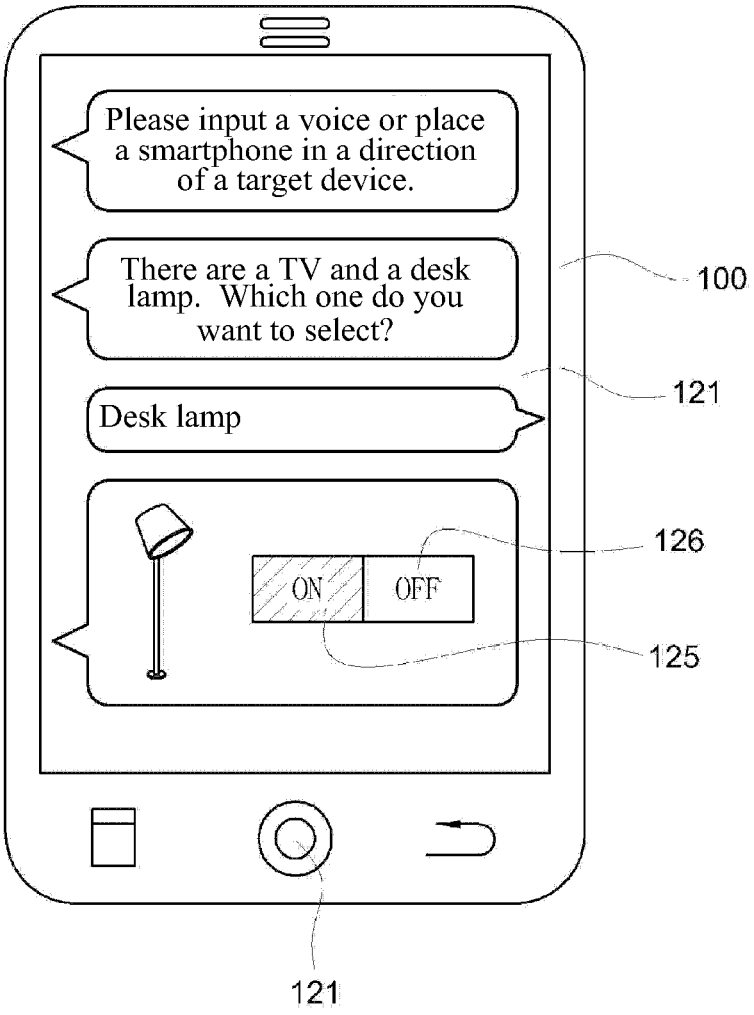

Referring to FIG. 15, the remote control device 100 may display a control menu corresponding to the selected device on the screen 121.

For example, the user may select an 'OFF' button 126 displayed on the screen 121, to turn off the desk lamp 204 that is current being in an 'ON' state, as shown in FIG. 11.

In this example, the user may provide a voice 'OFF' to select the 'OFF' button 126. Additionally, the voice of the user may be interpreted based on control program information on a corresponding device that is received in advance in the voice recognition server 400.

The remote control device 100 may be used as the voice recognition server 400 to receive a result of voice recognition of the interpreted control command.

The remote control device 100 may transmit a control command corresponding to the selected target device, that is, the desk lamp 204, based on the interpreted control command.

A result obtained by executing the transmitted control command may be displayed on the screen 121 of the remote control device 100.

Figure 16:
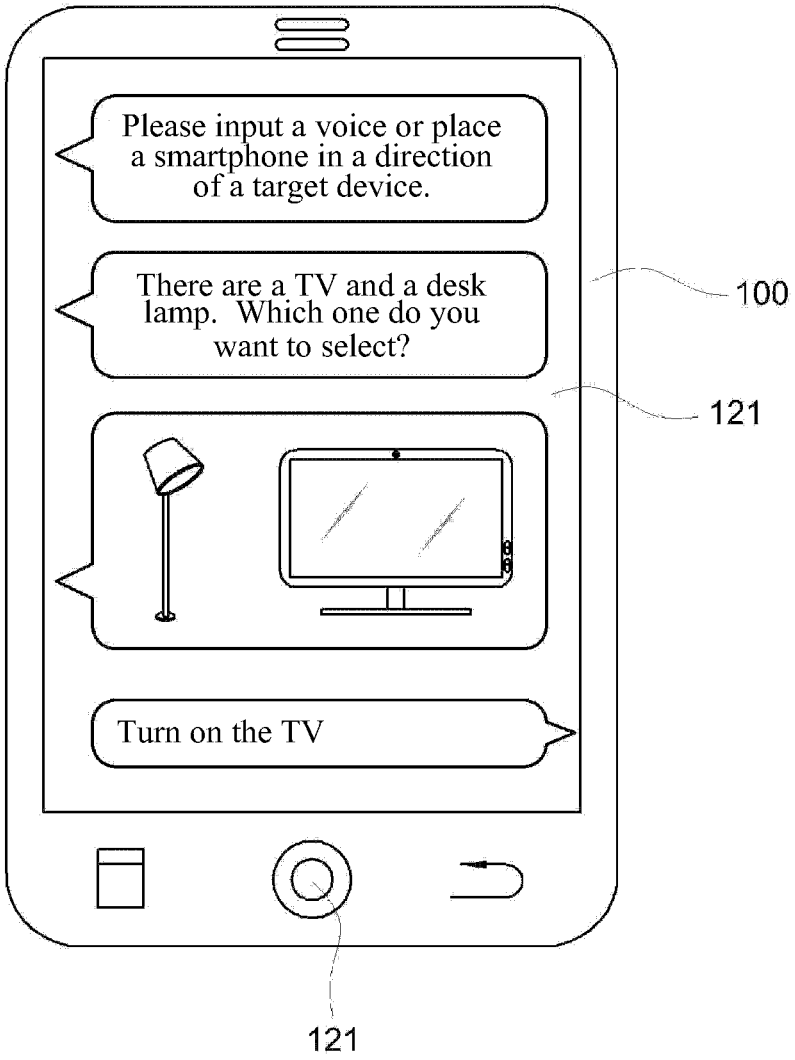
FIG. 16 is a diagram illustrating another example of a method of selecting a specific target device using voice recognition and controlling the specific target device.

FIG. 16 is a diagram illustrating another example of a method of selecting a specific target device using voice recognition and controlling the specific target device according to an embodiment.

Referring to FIG. 16, a target device may be selected by a user, while a control command corresponding to the selected target device is executed.

For example, when the TV 201 and the desk lamp 204 are found as controllable devices when the remote control device 100 transmits an IR signal, the user may provide a voice input 'Turn on a TV,' to select the TV 201 as a target device and simultaneously to request a command to turn 'ON' the TV 201.

Text on the screen 121 as shown in FIGS. 12 through 16 may be output in a voice through a speaker of the remote control device 100.

Additionally, the remote control device 100 may transmit an IR signal and may select one of a plurality of target devices as described above with reference to FIGS. 11 through 16, however, there is no limitation thereto. Accordingly, various signals with straightness other than the IR signal may be used to select a target device, and the above control method may also be applicable to the various signals.

The methods according to the above-described embodiments of the present invention may be written as computer programs, and may be recorded in a non-transitory computer readable recording medium. Examples of the non-transitory computer readable recording medium may include a ROM, a RAM, CD-ROMs, magnetic tapes, floppy disks, optical data storage devices, and carrier waves, such as data transmission through the Internet.

The non-transitory computer readable recording medium may also be distributed over network coupled computer systems so that the computer readable code is stored and executed in a distributed fashion. Also, functional programs, codes, and code segments for accomplishing the present invention may be easily construed by programmers skilled in the art to which the present invention pertains.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. A remote control method, comprising:

transmitting a device selecting signal;

receiving a response signal from a target device that is to be controlled and that receives the device selecting signal;

identifying the target device based on the response signal;

changing at least one of an angle of beam spread and a direction of the device selecting signal, when a plurality of target devices to be controlled are identified; and generating a remote control signal based on device control information corresponding to the identified target device, and transmitting the remote control signal to the target device, wherein the step of changing at least one of an angle of beam spread and a direction of the device selecting signal comprises:

reducing the angle of beam spread of the device selecting signal at a predetermined interval;

requesting a device that receives the device selecting signal to transmit the response signal; and reducing the angle of beam spread of the device selecting signal until one of the plurality of target devices is selected.

2. A remote control method, comprising:

receiving at least one of a key input and a voice recognition of a user;

transmitting control program information of each of a plurality of target devices to a voice recognition server via a communication unit by using a network;

interpreting a user command based on the received control program information by the voice recognition server;

transmitting a device selecting signal in response to the interpreted user command;

receiving a response signal from a target device that is to be controlled and that receives the device selecting signal;

identifying the target device based on the response signal;

selecting one of a plurality of target devices to be controlled by recognizing a user's voice, when the plurality of target devices are identified; and generating a remote control signal based on device control information corresponding to the identified target device, and transmitting the remote control signal to the target device.

* * * * *